US005938191A

United States Patent [19]

Morrison et al.

[11] Patent Number: 5,938,191

[45] **Date of Patent: *Aug. 17, 1999**

[54] SEGMENTED DRIVE ROLL FOR EXIT NIP PRIOR TO EXIT TRAYS

[75] Inventors: Elden R. Morrison, Rochester; Jason P. Rider, Fairport; Russell C. Rackett, Webster, all of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,389

[22] Filed: Sep. 30, 1996

[51] Int. Cl.[6] ..... B65H 29/68; B65H 29/70; B65H 29/20; B65H 3/06

[52] U.S. Cl. ..... 271/182; 271/188; 271/314; 271/119

[58] Field of Search ..... 271/182, 188, 271/314, 119, 313, 274

[56] References Cited

U.S. PATENT DOCUMENTS

| | | | |
|---|---|---|---|
| 2,950,675 | 8/1960 | Copping et al. | 271/314 |
| 4,073,223 | 2/1978 | Crawford | 271/182 |
| 4,124,204 | 11/1978 | Van Buskirk | 271/173 |
| 4,569,514 | 2/1986 | Holtje | 271/182 |
| 4,775,142 | 10/1988 | Silverberg | 271/274 |
| 4,831,416 | 5/1989 | Benson | 355/309 |
| 4,969,640 | 11/1990 | Littleton | 271/182 |
| 4,997,179 | 3/1991 | Mizutani et al. | 271/274 |
| 5,087,025 | 2/1992 | Hamada | 271/274 |
| 5,110,105 | 5/1992 | Nicoll et al. | 271/274 |
| 5,163,674 | 11/1992 | Parks | 271/274 |
| 5,273,269 | 12/1993 | Iwanaga | 271/124 |
| 5,383,656 | 1/1995 | Mandel et al. | 271/182 |
| 5,390,906 | 2/1995 | Ishii | 271/119 |
| 5,606,357 | 2/1997 | Bekki | 271/274 |
| 5,700,005 | 12/1997 | Chen | 271/188 |

FOREIGN PATENT DOCUMENTS

| | | | |
|---|---|---|---|
| 0135040 | 10/1980 | Japan | 271/124 |
| 0002633 | 1/1989 | Japan | 271/119 |
| 0144363 | 6/1990 | Japan | 271/188 |
| 404358646 | 12/1992 | Japan | 271/188 |
| 405032337 | 2/1993 | Japan | 271/124 |

*Primary Examiner*—William E. Terrell
*Assistant Examiner*—Wonki K. Park
*Attorney, Agent, or Firm*—Annette L. Bade

[57] ABSTRACT

An apparatus and method for slowing down the ejection velocity of the print media into an output tray, without the use of active velocity control of the exit nip or interface, utilizing a non-circular drive roll running against a leaf spring. The regions of contact of the non-circular drive roll are driven at a velocity slower than the incoming sheet velocity, and the spaces between the regions of contact are used to enable relaxation of buckling generated in the print media (e.g. print sheets). The print media travels at the velocity of the upstream nips until they are entirely under the control of the non-circular drive roll exit nip, thus enabling the sheets to be ejected from the exit nip, at a slower velocity, improving stacking registration.

6 Claims, 3 Drawing Sheets

SEGMENTED DRIVE ROLL FOR EXIT NIP PRIOR TO EXIT TRAYS

BACKGROUND OF THE INVENTION

This invention relates generally to an electrostatographic printer and copier, and more particularly, to a segmented drive roll for an exit nip prior to the exit trays.

In high speed copiers, the process speed of the paper at the exit nip of the purge and sample trays, or all exit trays in general, is too fast to achieve acceptable stacking.

Two methods currently used to reduce the speed of the paper at the exit nip both rely on sensing when the trail edge of the paper exits the next to the last nip in the paper path. In the first method, a stepper motor is used to slow the exit nip down after the trail edge of the paper has left the preceding nip. The second method utilizes a solenoid to elevate the idlers of the final nip which is traveling at a lower surface speed than the preceding nip. Just as the trail edge of the sheet is exiting the next to last nip the solenoid releases and drives the sheet out at reduced speed. Both of these methods involve complexities that result in significant UMCs (unit manufacturing costs). In the first method, the stepper motor method requires the expense of both the stepper motor and a controller board, and when combined with the extensive development time necessary, adds significant expense to the final cost of the machine. In the second method, using the solenoid is not as costly as the stepper method, but still requires complex mechanisms to lift the idler shaft, which adds to the UMC. In addition, the solenoid method requires a large area in the machine for mounting the hardware, which sometimes is not available. In both situations, software must be present which senses the trail edge of the sheet to signal the stepper motor or solenoid to take the appropriate action.

The following disclosures may be relevant to various aspects of the present invention and may be briefly summarized as follows:

Application Ser. No. 08/583,907, filed Jan. 11, 1996, to Rider et al., discloses an apparatus and method that describes utilizing a corrugation slip nip system, including a variable force idler that encompasses three stages, to prevent buckling of print media traveling at a high rate of speed upon exiting from a high speed printing machine to the exit tray for stacking. Buckling concerns are eliminated by allowing the sheet, driven by a high speed positive drive nip, to slip through the slower speed corrugation nip, yet still having enough drive force in the slip nip to drive the sheet into the exit tray. In order to vary the normal force on the sheet, a three stage variable force idler is used. The first stage oversizes the inner diameter of the idler rollers on the idler shaft. The second stage uses a slot in the spring which allows the idler shaft to move upward without deflecting the spring. These first two stages are particularly adapted for light weight paper. The third stage occurs when the idler shaft is topped out in the shaft slot such that the paper deflects the spring causing additional force to be applied to the paper to drive the paper out of the system and into the exit tray. The third stage is reached only where heavy weight paper is used because heavy weight paper has sufficient beam strength to deflect the spring.

U.S. Pat. No. 4,124,204 to VanBushkirk discloses an improved sorting apparatus and reproducing machine provided with a plurality of sheet receiving bins. A first frame supports the bins. A sheet transport is arranged in a second frame. The frames are supported for relative movement between a first closed position wherein the sheet transport is operatively associated with the bins and a second open position wherein the sheet transport is operatively associated with the bins and a second open position wherein access is provided to the transport and bins for sheet clearance. The sheet transport includes at least one belt which is operatively maintained under a desired tension. A device is provided for reducing the belt tension in response to the relative movement of the frames between their respective closed and open positions. In accordance with another feature, a counterbalance is provided for counterbalancing the frame supporting the transport as it moves away from the frame supporting the bins. The counterbalance comprises at least one type device mounted to the transport frame which engages the cantilever spring.

SUMMARY OF INVENTION

Briefly stated, and in accordance with one aspect of the present invention, there is provided an apparatus for reducing speed of a print media traveling at a high rate of speed toward an exit tray, comprising: the print media having a first surface and a second surface opposite the first surface; a segmented roller being rotatable, having a region of periodic contact with the second surface of the print media; and a device, having low frictional force, in contact with the first surface of the print media directly opposite the region of periodic contact between the second surface of the print media and the segmented roller; and a first roller being located upstream, in the direction of motion of the copy media, from the segmented roller, the first roller being rotatable contacting the print media and advancing the print media toward the segmented roller.

Pursuant to another aspect of the present invention, there is provided a method of reducing speed of a print media traveling at a high rate of speed toward an exit tray, comprising: advancing the print media along a print media path toward the exit tray at a high rate of speed using a series of drive rollers; reducing the speed of the print media by rotating a segmented roller, located downstream in the direction of motion of the print media, at a rotational surface speed slower than the speed of the drive rollers and sufficient to prevent removal of an interdocument zone between a first print media and a second print media.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 3:
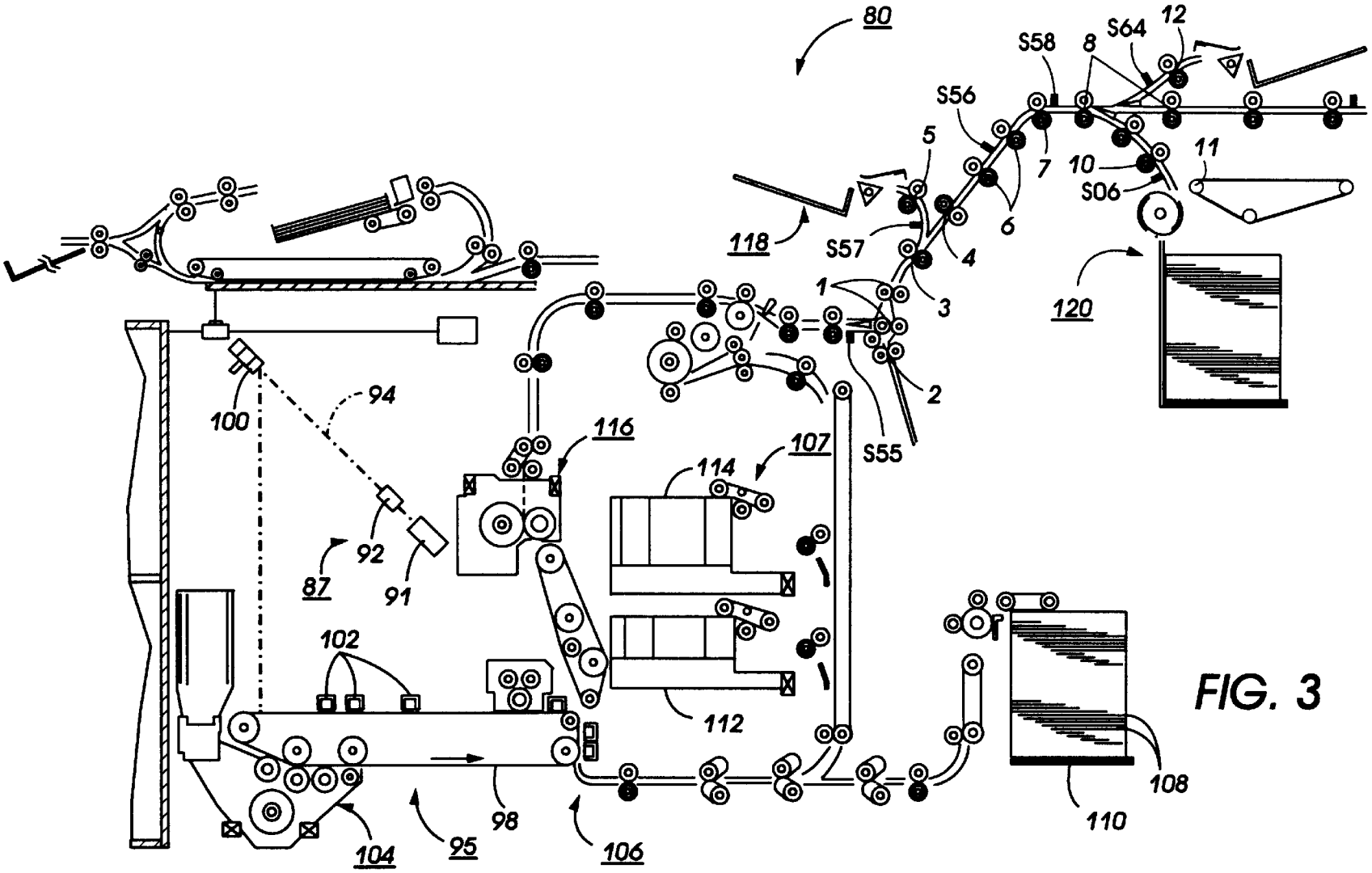
FIG. 3 is an elevational view illustrating the principal mechanical components of a printing system incorporating the present invention therein.

Reference is now made to the drawings where the showings are for the purpose of illustrating a preferred embodiment of the invention and not for limiting same, the various processing stations employed in the printing machine illustrated in FIG. 3 will be briefly described.

Referring now to FIG. 3, printer section 80 comprises a laser type printer and for purposes of explanation is separated into a Raster Output Scanner (ROS) section 87, Print Module Section 95, Paper Supply section 107, and Finisher 120. ROS 87 has a laser, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, or to a deck assembly stacker 125. Sensors are indicated by S55, S56, S57, S58, S64, S07, and S06.

With continuing reference to FIG. 3, the following chart provides a description of the nip area and approximate speed comparison for two sample printing machine speeds through 12 nip areas.

| NIP number | NIP Description | 135 cpm (~mm/s) | 180 cpm (~mm/s) |
|---|---|---|---|
| 1 | Inverter Tri-Roll NIPs | 935 | 1244 |
| 2 | Inverter Reversing NIP | 1008 | 1343 |
| 3 | Lower Post-Inverter NIP | 935 | 1244 |
| 4 | Upper Post-Inverter NIP | 935 | 1244 |
| **5** | **Sample Tray NIP** | **977** | **753** |
| 6 | Registration NIPs | 920 | 1278 |
| 7 | Post-Reg NIP 1 | 963 | 1270 |
| 8 | Post-Reg NIP 2 | 969 | 1278 |
| 9 | Bypass NIPs | 969 | 1278 |
| 10 | Pre-Disk NIP | 969 | 1278 |
| 11 | Trail Edge Assist Roll | 1170 | 1545 |
| **12** | **Purge Tray NIP** | **969** | **900** |

For example, as shown in the above chart, by increasing the cpm (copies per minute) from about 135 cpm to about 180 cpm causes an increase in process speed from about 940 mm/sec to about 1240 mm/sec. To eliminate possible buckling, the exit trays must be driven faster than the previous NIP, as shown in the speeds at 135 cpm (935 mm/sec to 977 mm/sec). However, using the present invention in NIP areas labeled 5 and 12, at 180 CPM, where exit trays are present, the speed of the print can be reduced from what is normally necessary to prevent buckling (about 1250 the sample tray), to a much more manageable speed (about 753 mm/sec).

Figure 1:
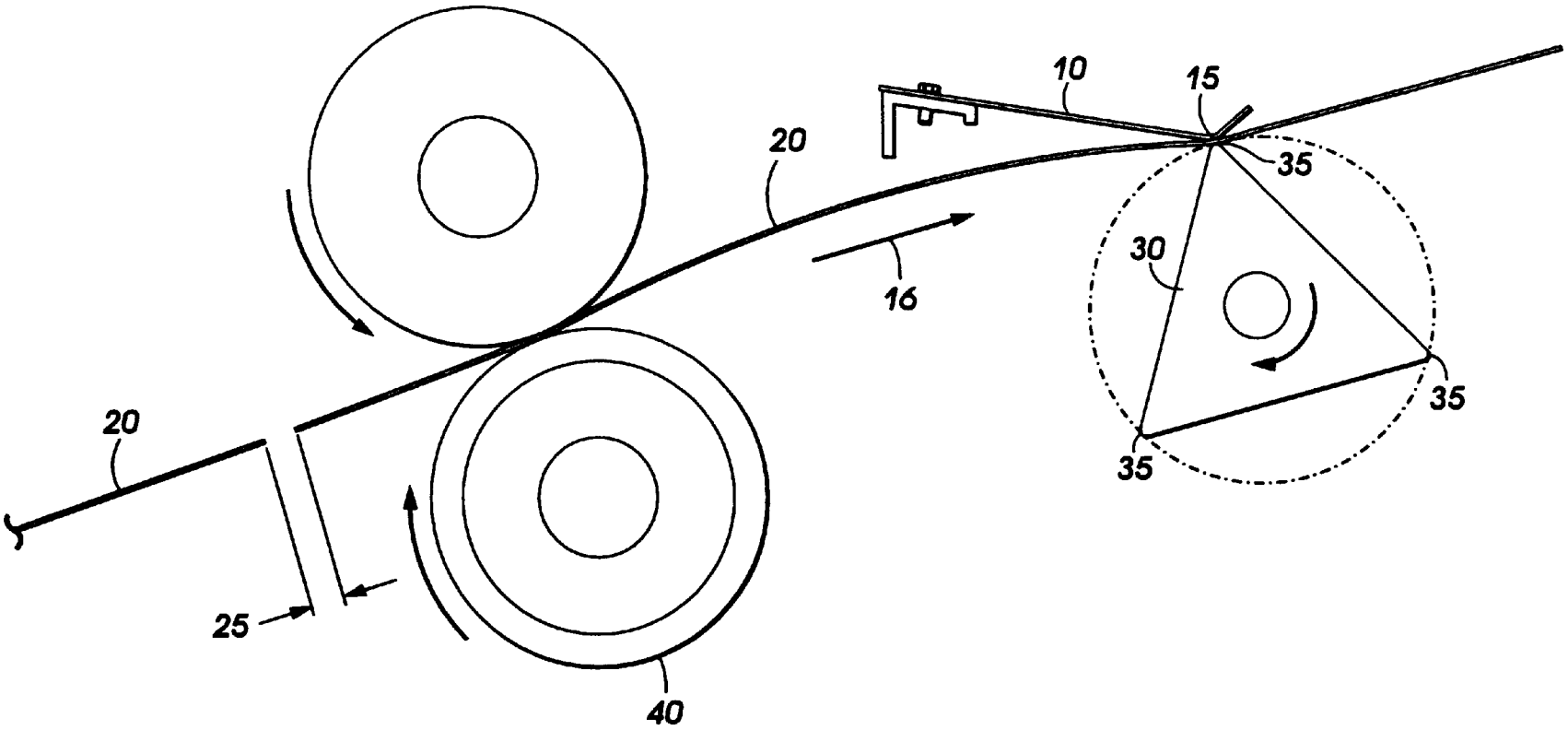
FIG. 1 is a schematic view of an embodiment of the present invention having a three node drive roll in the contact stage.

Reference is now made to FIG. 1, which shows a schematic view of the segmented drive roll of the present invention. An advancing driving roller 40, rotating at a high rate of speed, advances the print media 20 along a paper path in the high speed machine. The present invention reduces the speed of the print media 20 to prevent excessive speed of the sheet upon exit that creates stacking problems. The inventive embodiment employs a segmented (e.g. non-circular) drive roll 30 and the application of a normal force opposite the segmented drive roll 30. A driving roll 40 is located upstream, in the direction of motion of the print media path. The rotational speed of the driving roller rotates at a surface speed greater than that of the segmented drive roll 30. A limiting factor controlling the lower limit of the surface velocity of the segmented drive roll 30 is the size of the interdocument gap or zone 25. Another lower limit speed constraint of the segmented drive roll 30 is that it must also be fast enough to sufficiently exit the interface 15 between the leaf spring 10 and the segmented rive roll 30, and clear any lip on the catch tray 118, 125 (see FIG. 3) to enable adequate stacking. The upper limit of the segmented roll speed is determined only by the ability to adequately stack the sheets. The normal force can be provided by, but not limited to, a leaf spring or idler rolls. By utilizing a leaf spring or idler rolls, the system can compensate for variations in paper weights of the print media.

Figure 2:
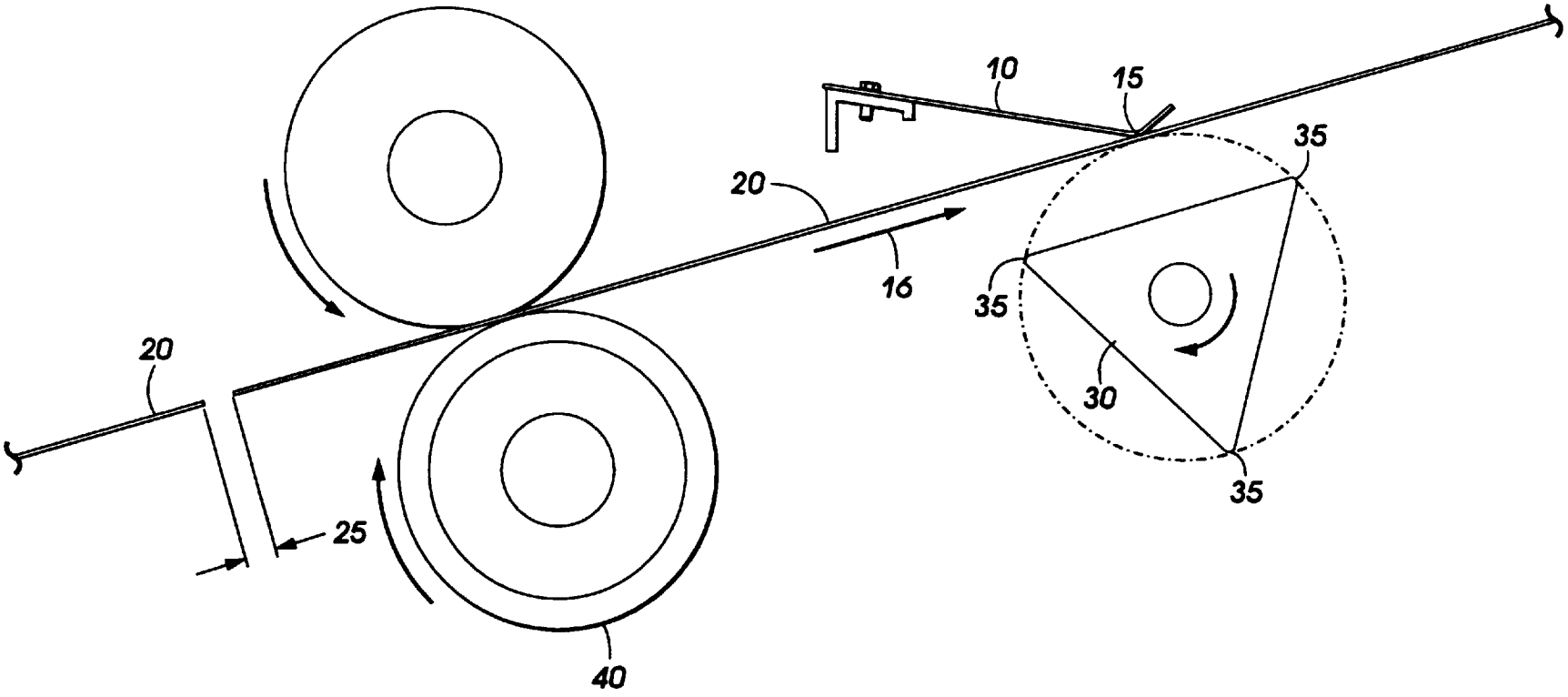
FIG. 2 is a schematic view of the drive roll in a non-contact stage.

The segmented drive roll 30 contains high points or nodes 35. (In FIGS. 1 and 2, an embodiment of the present invention is shown having three nodes 35 separated by 120 degrees from one another.) The number of nodes can be varied. The number of nodes affects the speed at which the drive roll 30 must be rotated. For example, the rotational speed of the drive roll 30 with less than three nodes, requires a faster velocity in order to contact the paper 20 or copy medium required to provide the exit speed and force needed to prevent jamming. Whereas, with more than three nodes on the drive roll 30, the speed of the drive roll can be reduced because the number of contact points moving the paper would cause exit of the paper at a faster rate. During a single rotation of the drive shaft each of the nodes 35 sequentially contacts the component supplying the normal force (e.g. in FIGS. 1 and 2 this component is a leaf spring 10). The paper enters the node/spring interface 15 at a point tangential to an arc described by nodes 35 of the segmented drive roller 30. During these periods of contact, the paper is pinched between a high friction node 35 and the low friction stationary spring 10 and is propelled toward the exit tray. Since this intermittent nip is traveling slower than the preceding nip, a small buckle will form during the brief contact period of the leaf spring 10 and the node 35 as shown in FIG. 1. Once the node 35 has passed out of contact with the spring 10, (and the non-contact portion of the drive roll is opposite the spring 10 at reference number 15 (see FIG. 2)) the beam strength of the paper 20 will cause the buckle to relax before any print media damage can occur. As shown in FIG. 2, when the segmented drive roll 30 is in the non-contact state, the nodes 35 are not in contact with a point tangent to the paper path (i.e., the non-contact state is where the node 35 is not in contact with the print media to advance the paper or print media forward). In the present invention, the sensing of the position of the trail edge of the paper is not required, nor is a stepper motor or solenoids or the hardware associated with these elements required. Hence, the present invention is less expensive and also less complicated than current methods.

In recapitulation, the present invention utilizes a segmented drive roll of low cost to achieve a reduction in paper velocity in a high speed copier or printer for use in exit trays.

It is, therefore, apparent that there has been provided in accordance with the present invention, a segmented drive roll that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for reducing speed of a print media traveling at a high rate of speed toward an exit tray, comprising:

the print media having a first surface and a second surface opposite said first surface;

a single segmented roller being rotatable, having a region of periodic contact with said second surface of the print media, wherein said region comprises at least one node; and a device, comprising a spring having low frictional force, in contact with said first surface of the print media directly opposite said region of periodic contact between said second surface of the print media and said segmented roller;

a first roller being located upstream, in the direction of motion of the copy media, from said segmented roller, said first roller being rotatable contacting the print media and advancing the print media toward said segmented roller; and said first roller rotates at a surface velocity greater than a rotational surface speed of said segmented roller.

2. An apparatus as recited in claim 1, wherein said segmented roller, comprises:

a first region of contact with the print media for advancing the print media toward the exit tray; and a second region of non-contact with said surface to reduce frictional contact of the print media between said low frictional force device and said segmented roller removing buckling of the print media.

3. An apparatus as recited in claim 2, wherein the print media comprises a succession of print media each spaced apart from one another by an interdocument zone.

4. An apparatus as recited in claim 3, wherein said first roller having a greater velocity than said segmented roller enables one of the print media to exit an interface between said segmented roll and said low frictional force device prior to the next of the print media entering the region of contact between said segmented roller and said low frictional force device.

5. An apparatus as recited in claim 4, wherein a region of said segmented roller contacts the copy media a "sufficient number" of times to advance the exiting copy media through the exiting interface between said segmented roller and said surface.

6. An apparatus as recited in claim 3, wherein a difference between the rotational surface speed of said first roller and said segmented roller prevents removal of the interdocument zone thereby preventing overlap of the print media with a subsequent print media.

* * * * *